United States Patent [19]

van de Werken

[11] 4,215,848

[45] Aug. 5, 1980

[54] GRIPPING AND SKIDDING APPARATUS

[75] Inventor: Pieter van de Werken, Sleeuwijk, Netherlands

[73] Assignee: MacGregor International S.A., Basel, Switzerland

[21] Appl. No.: 937,843

[22] Filed: Aug. 29, 1978

[30] Foreign Application Priority Data

Aug. 30, 1977 [NL] Netherlands ..... 7709542

[51] Int. Cl.[2] ..... B66F 1/00

[52] U.S. Cl. ..... 254/107

[58] Field of Search ..... 254/105, 106, 107; 294/87 R

[56] References Cited

U.S. PATENT DOCUMENTS 3,464,095 9/1969 Chambers ..... 254/107

FOREIGN PATENT DOCUMENTS 116289 12/1958 U.S.S.R. ..... 254/105

*Primary Examiner*—Robert C. Watson

*Attorney, Agent, or Firm*—Cushman. Darby & Cushman

[57] ABSTRACT

Gripping and skidding device for skidding modules placed on the platform of a marine drilling rig by a crane. The apparatus is arranged to hydraulically engage the top plate of a girder by at least two opposed gripping units each having gripping faces relatively narrow and short relative to the top plate, and preferably one of which is formed by the surface of a gripping beam mounted for pivoting movement on a universal hinge, thereby ensuring, among other advantages, optimum clamping capacity even if the top plate is warped.

8 Claims, 11 Drawing Figures

FIG. 3
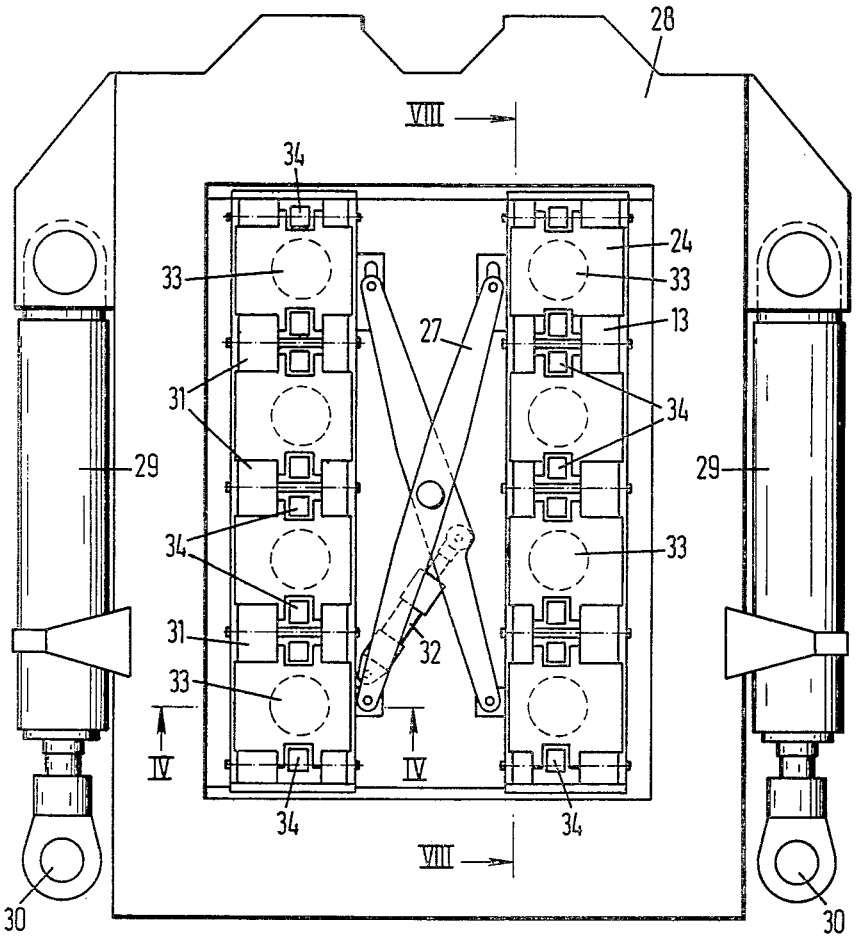
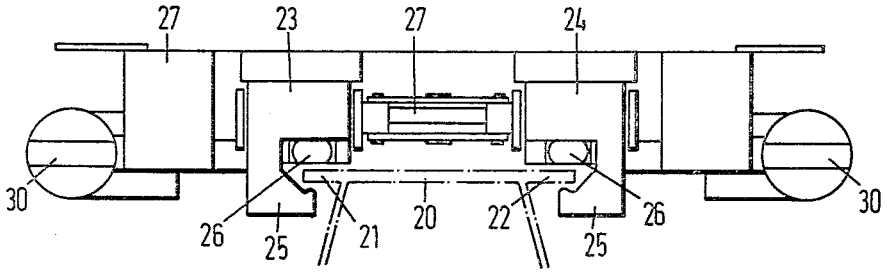
FIG. 2

GRIPPING AND SKIDDING APPARATUS

The invention relates to a gripping and skidding apparatus as used for skidding modules positioned by a crane barge on the platform of a marine drilling rig.

The platform of a drilling rig is formed by longitudinal girders and cross girders which are secured on the legs of the drilling rig. On such a platform are positioned modules; these are box-shaped units comprising crew accommodations, engine rooms, storage rooms and the like. Such modules, which may weigh up to 2000 tons and more, are supplied by vessel and positioned by a crane of a crane barge on the platform. Since it is not quite possible to position the modules by means of the crane immediately in the proper position, use is made of hydraulic gripper and skidding devices for properly positioning the modules on the platform. Said gripper and skidding devices are adapted therefor to engage the top plate of girders extending on either side beyond the girders, clamping same hydraulically. Furthermore there are provided hydraulically operated push members which, once the apparatus has been clamped onto the upper plate, are adapted to push a module positioned in front of the gripper and skidding devices so as to skid same over a given distance. When the module has been skidded, the gripper and skidding devices are released and the gripper and skidding device can pull itself to the module by means of push means attached to the module. Subsequently the devices are again secured on the top plate and the module can again be skidded further.

In the use of the hitherto available gripper and skidding devices problems were mostly encountered in that the top plate of the girders, which may for instance be 1 meter in width and 45 meters in length, in practice does not appear to be flat neither crosswise nor longitudinally, but concave or convex, respectively corrugated. This results in that the apparatus cannot be clamped optimally, so that the pushing capacity is considerably reduced.

Another drawback is that the prior art devices have always to be pushed at one end of the girder (skidbeam) on the girder, and have to be removed from the girder (skidbeam) at one end thereof.

Still another drawback is that the top plate of the girders sometimes does not project equally far from both sides, so that in certain cases there is no room at one side for gripping purposes. The prior art devices can then not be employed.

Also, the prior art devices cannot be adapted to the size of the load to be skidded.

It is the object of the invention to remove the above drawbacks. To this effect according to the invention a gripper and skidding device of the above described type, which is adapted to hydraulically grip the top plate of a girder (skidbeam) and which is provided with hydraulically operated push-pull means, is characterized by one or more gripping units which, independently of each other, are adapted for coaction with a projecting flange of the top plate and which each are provided with narrow and short clamping surfaces relatively to the top plate.

The invention will now be explained, by way of example, with reference to the accompanying drawings.

FIG. 1 diagrammatically shows a marine drilling rig whereon a module to be skidded is positioned;

FIG. 2 is partly a cross-section of a girder (skidbeam) provided with horizontal flanges, on which an embodiment of a device according to the invention is positioned;

FIG. 3 is a top view of an embodiment of a gripper and skidding device according to the invention;

Figure 1:
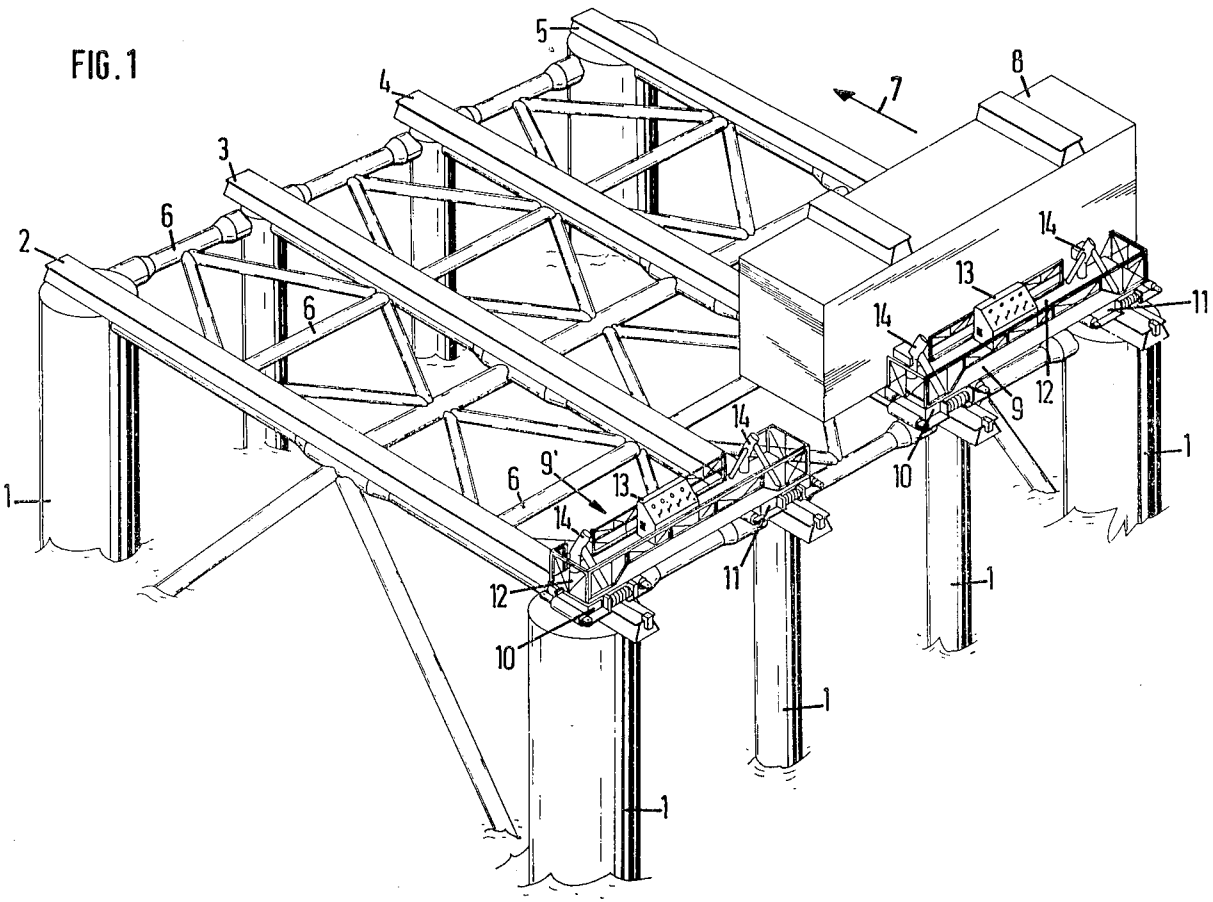

FIG. 1 shows a marine drilling rig under construction. The rig is placed on legs 1 on which is disposed a platform of girders (skidbeams) 2–5 having a top plate and cross girders 6. Furthermore the platform accommodates in a known manner various diagonal reinforcements. On the girders (skidbeams) 4 and 5 provided with top plates having flanges projecting on either side there is positioned a module 8 which is to be skidded in the direction of arrow 7. The weight of such a module may amount from a few hundred to a few thousand tons.

In order to be able to skid the module there is likewise positioned on girders (skidbeams) 4 and 5 a construction 9, which comprises two gripper and skidding devices, 10, 11 according to the invention, connected by a bridge 12, and adapted to cooperate for skidding the module 8. As shown in the drawing there is positioned on the bridge 12 a box 13 comprising operating apparatus and furthermore the bridge is provided with abutment means 14. For clearness' sake there is depicted a second construction 9′ positioned on the girders 2 and 3 (skidbeams), the components of which are indicated by the same reference numerals as the components of the first construction.

For a further description of the gripper and skidding devices 10, 11 reference is made to FIGS. 2 and 3.

FIG. 2 shows a front view of an embodiment of a gripper and skidding device according to the invention. The device is disposed on a girder (skidbeam) having a top plate 20 projecting on either side. The projecting portions of the top plate, the flanges, are indicated by 21 and 22. About flanges 21, 22 engage gripper units 23, 24 resp. The gripper units have jaws having a passive portion 25 and an active portion, the gripper beam 26. The active portion can be pressed against the associated flange by means of hydraulic cylinders, thereby pulling the passive portion likewise against the flange so that the jaw tightly fits about the flange. The oppositely positioned gripper units are interconnected through a hydraulic continuously adjustable coupling device 27 which will be further described hereinafter. A number of gripper units (two times four in FIG. 3) is surrounded by a frame 28. On the frame are attached on either side hydraulically operated push-pull means 29 which are provided with attachment means 30 in order to be coupled to the module to be skidded, possibly through suitable couplings.

The gripper and skidding device shown in FIG. 2 comprises at least two oppositely disposed gripping units 23, 24, respectively. Such an embodiment is in particular suitable for the situation wherein the flanges of the top plate actually project sufficiently from both sides of the girder to be gripped by a gripping unit. However, this is not always the case. Sometimes the situation occurs wherein only one of the flanges offers the opportunity to apply a gripping unit. The invention then offers the possibility to design the gripper and skidding device with only one gripping unit which can be clamped on the sufficiently projecting flange, or with a plurality of tandem-arranged gripping units which are placed on the same flange. This is possible in that the gripping units are adapted for coaction, entirely independently from each other, and oppositely disposed gripping units need not be coupled to each other by a force-transmitting frame for ensuring a proper operation.

This would mean, starting from the situation shown in FIG. 2, that the gripping unit 24 is omitted when the flange 22 does not project sufficiently. The coupling device 27 could then be omitted or be so modified that a guidance along the right-hand side of the girder (on the drawing) is produced, e.g. by applying a hook-shaped portion which engages about the right-hand side of the girder. Another possibility is to modify the frame 28 in such a way that it ensures the guidance along the girder. Such modifications are obvious to one skilled in the art and therefore have not been further depicted in the Figures.

FIG. 3 shows a gripper and skidding device having four gripper units on each side, which units are resiliently interconnected. According to a preferred embodiment of the invention the tandem-disposed gripper units are coupled through blocks 31 of synthetic material functioning as resilient hinge.

The oppositely disposed rows of four gripper units are interconnected through a hydraulically adjustable linkage 27. To this effect a double-acting hydraulic cylinder 23 is disposed between the legs of the linkage, which linkage allows for the gripper units to be pushed apart in transverse direction such that the gripper and skidding devices can be removed or applied vertically in any desired place. Furthermore the linkage allows the distance between the opposite gripper units to be adapted to the width of the top plate of the respective girder (skidbeam).

If only two opposite gripper units are utilized, it is not necessary to apply a linkage construction, but the connection 27 can be formed by a single, double-acting hydraulic cylinder. Possibly also mechanically adjustable connections can be used, but this is mostly not preferred.

FIG. 3 furthermore shows diagrammatically the hydraulic cylinders 33 supplying the gripping force for the jaws, while reset cylinders for each jaw are diagrammatically indicated by 34.

The operation of the above described gripper and skidding device is the following. After the device has been properly positioned, the gripper cylinders 33 are energized so that the jaws will engage about the flanges, and the attachment means 30 are coupled to the module to be skidded. Subsequently the hydraulic push-pull means 29 are energized so that the module is pushed away from the device. When the push-pull means have attained the outer position, the gripper cylinders 33 are released and the reset cylinders 34 are energized, so that the jaws will no longer engage the flanges. Then the hydraulic push-pull means are energized in opposite direction, so that the gripper and skidding device is pulled across the girder (skidbeam) towards the module; after this the gripper cylinders 33 are energized again and the above described cycle is repeated a required number of times until the module has arrived at the proper place.

Figure 4:
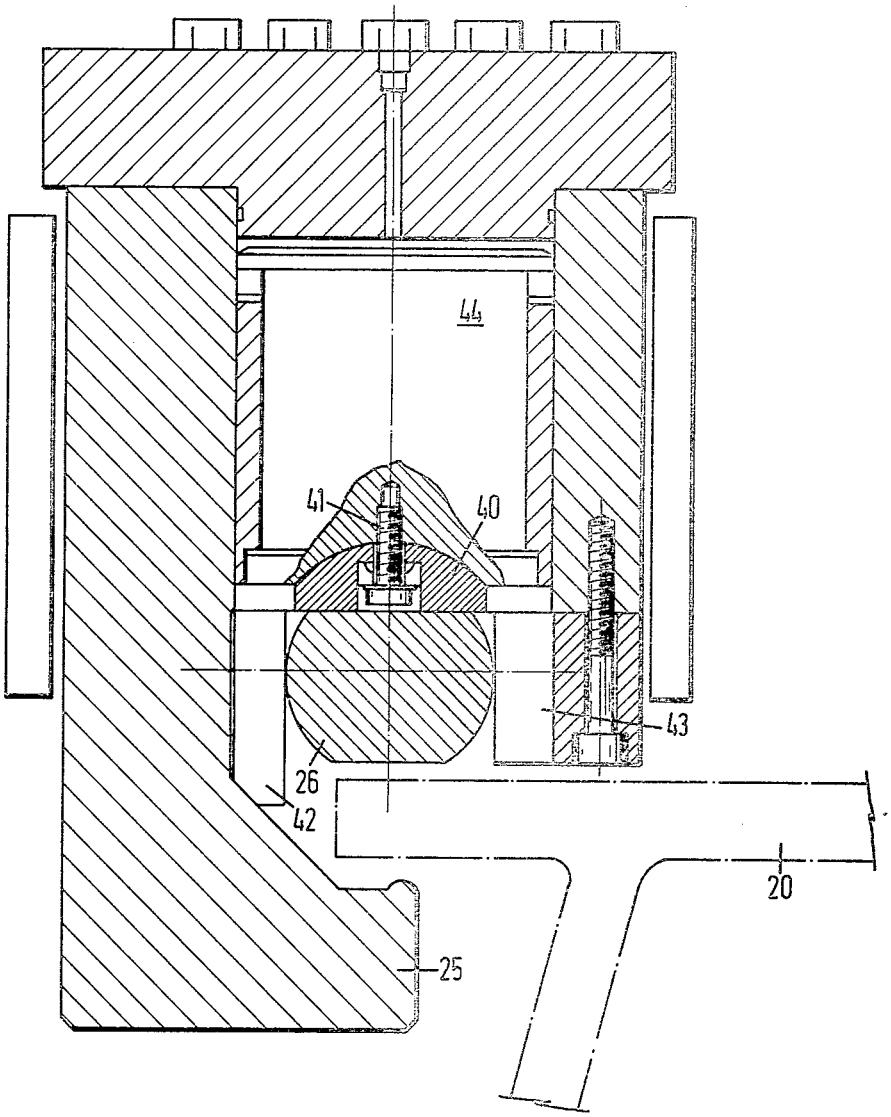
FIG. 4 is a cross-section of an embodiment of a gripping unit according to the invention, as applied in FIG. 3.
Figure 5:
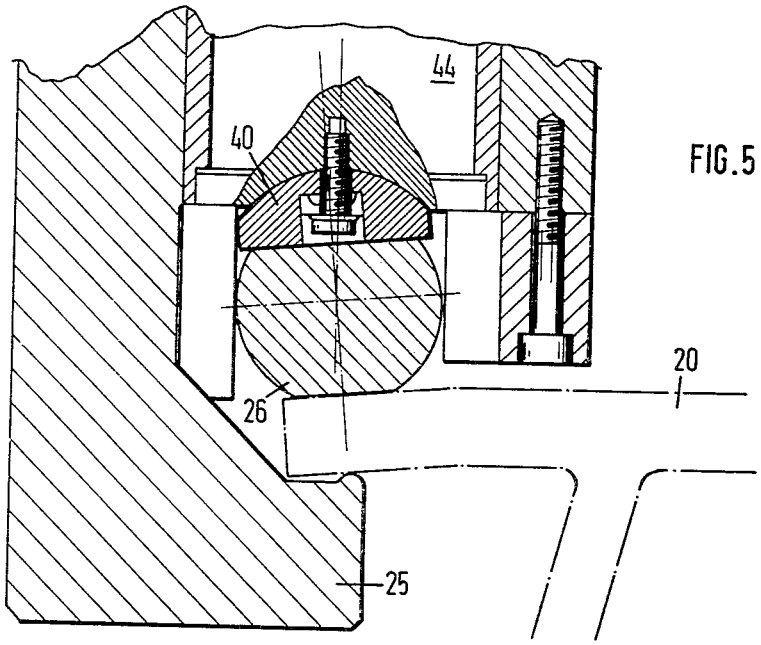
FIGS. 5 and 6 show a cross-section corresponding to FIG. 4 in case of non-fat flanges.
Figure 6:
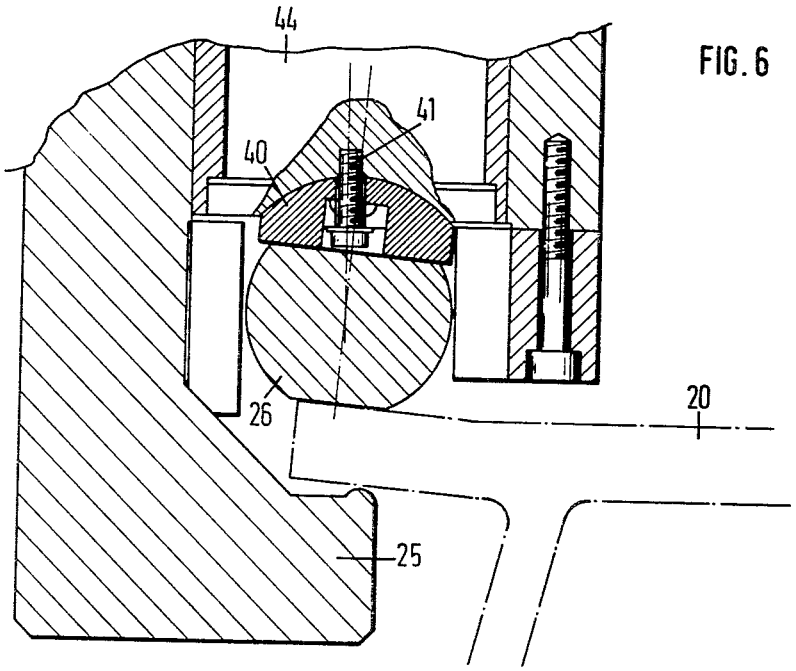

FIG. 4 shows a cross-section of a gripper unit according to the invention. This gripper unit, as already indicated, may be applied separately or in combination with oppositely disposed and/or series-connected gripper units. The gripper beam 26, via a universal hinge which in the present embodiment has the form of a convex pivot disc 40 and a fastening bolt 41, is mounted rotatably substantially in all directions between two webs 42, 43 to the gripper piston 44 of the gripper cylinder 33. Through this construction there is obtained the very important advantage that the position of the gripper beam, upon energization of the gripper cylinder, is automatically adapted to the shape of the top plate of the longitudinal girder (skidbeam) which is often not flat but convex or concave, or which has bent flanges. In this manner an adequate gripper action can be achieved also in case of a deformed top plate, which was not possible with the conventional devices. The effect of the above described construction is clearly shown in FIGS. 5 and 6.

In addition to cross-wise deformation of a girder (skidbeam) mostly also deformation in longitudinal direction of a girder (skidbeam) occurs, so that the girder (skidbeam) may have corrugations. In the known devices, in which longer gripping means are applied according as the load to be skidded was heavier, it may happen that through the corrugated configuration of a longitudinal girder (skidbeam) no sufficient grip on the girder (skidbeam) can be obtained to skid the load.

Figure 7:
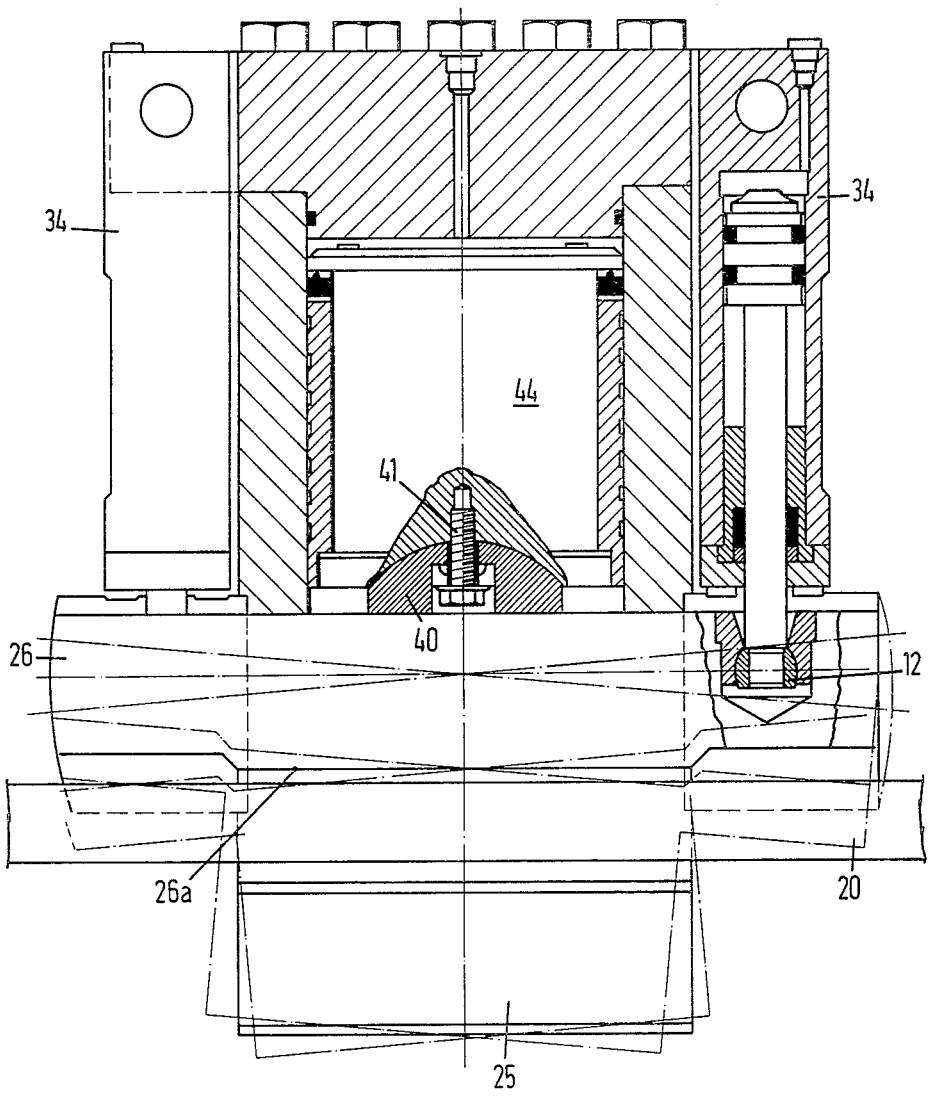
FIG. 7 is a longitudinal section of a gripper unit according to the invention.

FIG. 7 shows that the convex pivot disc 40 enables a rotation of the gripping beam 26 also in longitudinal direction, which in combination with the relatively short gripping face 26*a* of the gripping beam, enables an adaptation to deformations of the girder (skidbeam) in longitudinal direction. A number of possible positions of the gripping beam is indicated by broken lines in FIG. 7.

Figure 8:
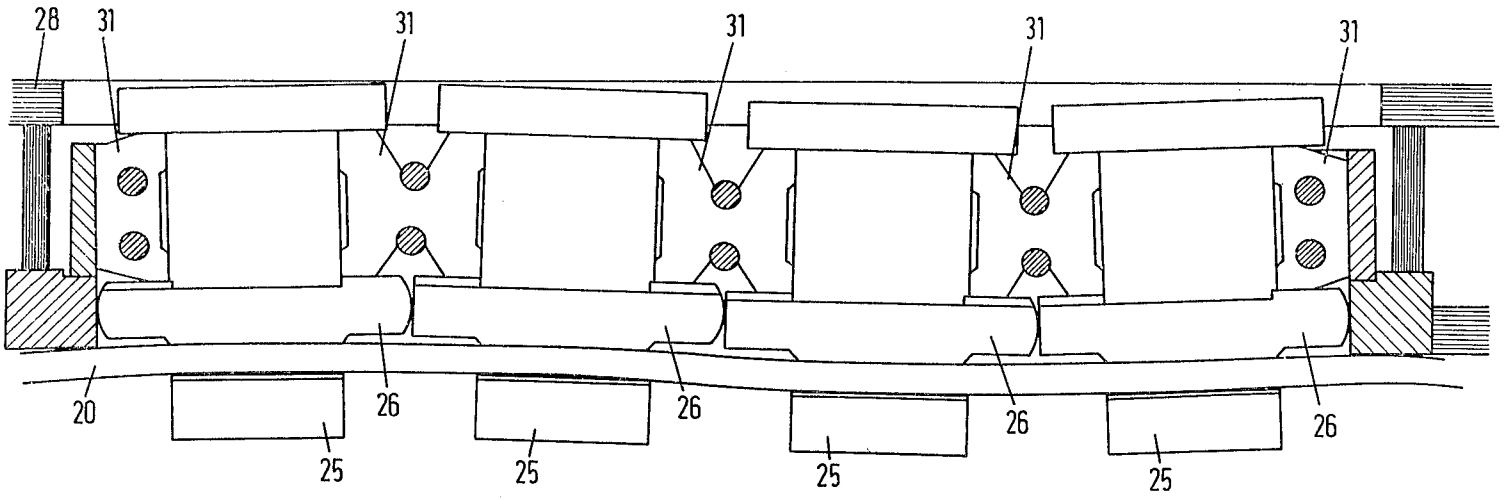
FIG. 8 is a cross-section on the line VIII—VIII in FIG. 3 in case of a flange corrugating in longitudinal direction.

FIG. 8 depicts in which manner a number of gripping units is adapted to coact for achieving the required total gripping force. The gripping units are adapted for relative pivoting movement in that each time between two gripping units, or between an outer gripping unit and the frame, there is disposed a resilient coupling piece 31, for instance of synthetic material or rubber. In this manner a sufficiently large contact face with the top plate of the girder (skidbeam) can be obtained by means of an assembly of gripping units also in case of a deformed longitudinal girder (skidbeam).

In order to achieve a proper power transmission between the successive gripping units mutually and to the frame, the head faces of the gripping beams rest against each other, respectively against the frame, one of two contacting head faces being each time rounded. Since the respective supporting faces of the frame are flat, one of the gripping means—the left beam in FIG. 8—has two rounded head faces.

It is observed that in the above the gripper and skidding device according to the invention is described in conjunction with the application thereof to a marine drilling rig. The gripper and skidding devices according to the invention, however, can be applied in all places where very heavy loads have to be moved. A remarkable application possibility is the shipyard where the modules are made, and where often the ready modules are transferred to the quay by means of very primitive and time-consuming means.

Summarizing, the following advantages of the gripper and skidding devices according to the invention can be enumerated:

1. The gripper and skidding devices according to the invention allow large tolerances in the girders (skidbeams) such as tolerances regarding the thickness, width and planeness of the top plate.

2. Deviations with respect to the location of the girders (skidbeams) can be taken up.

3. The gripper and skidding devices according to the invention are highly irresponsive to deflection of the girders (skidbeams).

4. The gripper and skidding devices according to the invention can be vertically positioned on the girders (skidbeams) in any desired place, or be removed from the girders (skidbeams).

5. The number of gripping units of the gripper and skidding devices according to the invention can be selected optionally dependent upon the load to be skidded in that loose gripping units are used which can be combined according to a construction box system.

6. The gripper and skidding devices may also have a single-faced design, i.e. the gripping units act only on one flange of a girder.

Another possible modification of the described embodiments is an embodiment wherein each gripper unit comprises a plurality, for instance five, of gripping pistons positioned in tandem-arranged parallel bores, which pistons, via a universal joint preferably designed in the manner as already described as a convex pivot disc connected to the gripping pistons, are coupled to separate gripping shoes. The gripping beam of the earlier described gripping units is then, as it were, divided into a plurality of gripping shoes which each are adapted for coaction with their own gripping piston, so that now again a proper adaptation to deformations of the girders, respectively the flanges thereof, is possible. Such a gripper unit may have a cross section as shown in FIG. 4. Preferably, however, in this embodiment the gripping pistons each form part of a double-acting piston/cylinder assembly which likewise functions for re-adjusting the piston, so as to restrict the number of cylinders required.

Also such gripping units may again be coupled in the described manner in order to obtain gripping and skidding devices that grip one flange or two flanges of a girder, and which comprises one or more series-connected gripping units.

Figure 9:
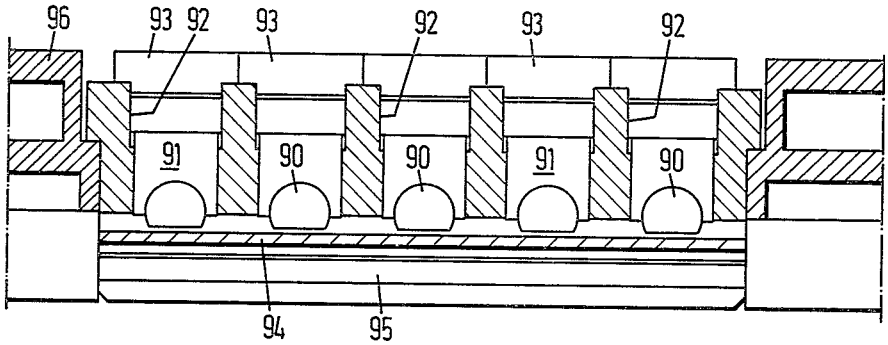
FIGS. 9 and 10 show another embodiment of a gripping unit according to the invention.
Figure 10:
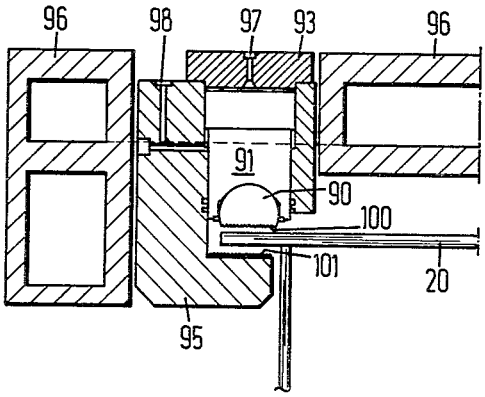
Figure 11:
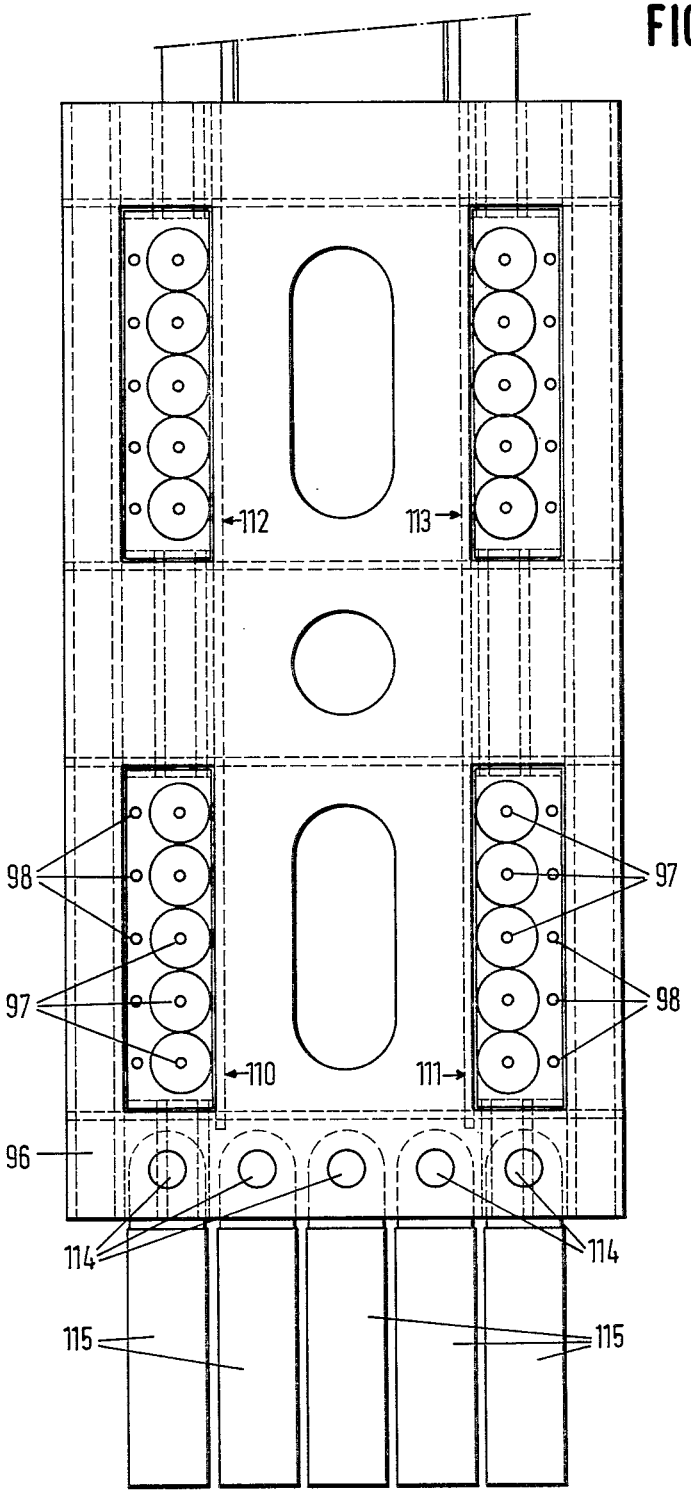
FIG. 11 shows a gripper and skidding device featuring four gripping units as shown in FIG. 9 and FIG. 10.

An embodiment of a gripper unit comprising a plurality of gripping pistons is shown in FIGS. 9 and 10 and a gripping and skidding apparatus comprising four such units is shown in FIG. 11.

FIG. 9 diagrammatically shows a longitudinal section of a gripping unit which is provided with a plurality of gripping shoes 90, which in actual fact replace the gripping beam of FIGS. 2–7. Each shoe is attached to the one end of an associated gripping piston 91 which is adapted to hydraulically move up and down in an associated bore 92 in the body of the gripping unit. The gripping unit is therefor provided with supply and discharge channels for a pressure fluid. These channels are not shown in FIG. 9 for clarity's sake, but are shown though in FIG. 10. The bores 92 adjacent the other end of the gripping pistons (at the top side of the Figure) are shut off by a fitting cover 93. By 94 is indicated a flange of a top plate 20 of a girder. When the gripping pistons are energized, the flange 94 is gripped between the gripping shoes 90 and the passive portion 95 of the jaw of the gripping unit.

It is observed that in the depicted embodiment five gripping pistons are applied. Naturally, however, any required number of gripping pistons may be employed.

The attachment of gripping shoes 90 may be realized similarly as the attachment of the gripping beam shown in FIG. 4. In certain situations, however, it will be sufficient to employ a stationary, non-pivoting attachment of the gripping shoes to the gripping pistons.

FIGS. 9–11 furthermore show that the gripping units are positioned in a recess in a frame 96. The gripping units are loosely placed in this recess and the frame serves only for defining the position of the gripping units and for taking up the shearing forces but not for transmitting gripping forces. A frame 96, comprising four of such gripping units, is shown in FIG. 11.

FIG. 10 shows in what manner the channels for the pressure fluid may be disposed. A first channel 97 is accommodated in the cover 93 and serves for moving the piston 91 downwardly. A second channel opens into the bore 92 underneath a collar of the piston and serves for re-adjusting the gripping unit. In this case therefore a double-acting piston/cylinder assembly is employed contrary to what was the case with the earlier described embodiments.

Furthermore, FIG. 10 shows at 100 and 101 that the gripping faces of the gripping shoes 90 and of the passive portion 95 may be provided with a rough surface or with a rough coating in order to increase the friction force during the skidding of the load.

FIG. 11 shows, as already observed, a frame 96 accommodating four gripping units 110–113 of the described type. The frame is furthermore provided with attachment points 114 for slide valve cylinders 115, which are coupled in operation to the load to be skidded.

It is observed that various modifications of the above described embodiment of the device according to the invention are obvious to one skilled in the art. For instance it is conceivable to utilize, instead of the above described convex pivot disc, another hinge construction with the same effect. The hinged gripping beam might also be attached on the other portion of the jaw of the gripping unit, while it will also be possible to provide each part of the jaw with such a hinged gripping beam.

I claim:

1. A gripper and skidding device which is adapted to hydraulically grip a flanged top plate of a girder comprising: a main frame; hydraulically operated push-pull means carried by the frame and connectable to a structure which is to be skidded on the girder; a plurality of gripping units carried by the frame, each gripping unit having opposed gripping faces for selectively gripping and releasing between them the upper and lower surfaces of the top plate flange of the girder, means for moving at least one of the gripping faces toward and away from an opposed face and a universal joint between said moving means and said movable face for permitting said face to adjust its position to accommodate to the shape of the flange at the location of the gripping unit, said plurality of gripping units being arranged side-by-side in a row in the push-pull direction so as to grip a plurality of adjacent locations along the length of the flange; and coupling means between adjacent gripping units permitting relative pivoting movement between the gripping units.

2. A device as in claim 1 wherein during operation the movable gripping faces of said gripping units abut each other and wherein one of each two abutting surfaces is rounded and the other is flat.

3. A device as in claim 2 wherein the gripping face of the gripping unit at each end of the row abuts a fixed part of the frame and wherein the surface of each face which abuts the frame is rounded.

4. A device as in claim 1 wherein there are two spaced-apart parallel rows of said gripping units so that both flanges of a girder top plate can be gripped, each row being mounted in a subframe; and means for pushing apart said subframes and their associated gripping units in a direction transverse to the rows to permit adjustment of the gripping units to girder top plates of different widths and to permit removal of the device from a girder at any desired location.

5. A device as in claim 4 wherein said means for pushing said subframes apart is located between said subframes.

6. A gripper and skidding device which is adapted to hydraulically grip a flanged top plate of a girder comprising: a main frame; hydraulically operated push-pull means carried by the frame and connectable to a structure which is to be skidded on the girder; a plurality of gripping units each having opposed gripping faces for selectively gripping and releasing between them the upper and lower surfaces of the top plate flange of the girder, means for moving at least one of the gripping faces toward and away from an opposed face, said plurality of gripping units being arranged in two spaced-apart parallel rows extending in the push-pull direction so as to grip a plurality of adjacent locations on each girder top plate flange, the gripping units of each row being supported in a subframe which is supported by the main frame; and means for pushing apart said subframes and their associated gripping units in a direction transverse to the rows to permit adjustment of the gripping units to girder top plates of different widths and to permit removal of the device from a girder at any desired location.

7. A device as in claim 6 wherein said subframes are disposed within an opening in the main frame so that the main frame laterally surrounds the subframes.

8. A device as in claim 7 wherein said means for pushing said subframes apart is located between said frames.

* * * * *